United States Patent [19]

Farmer et al.

[11] 4,160,620

[45] Jul. 10, 1979

[54] LIFT TRUCK PAPER ROLL CLAMP HAVING IMPROVED CONTACT PAD RESTRAINT AND HINGE STRUCTURE

[75] Inventors: Stanley E. Farmer, Troutdale; Harry F. Weinert, Portland, both of Oreg.

[73] Assignee: Cascade Corporation, Portland, Oreg.

[21] Appl. No.: 829,631

[22] Filed: Sep. 1, 1977

[51] Int. Cl.[2] ..... B66F 9/18

[52] U.S. Cl. ..... 414/621; 294/88; 414/620; 414/911

[58] Field of Search ..... 214/650 R, 651, 652, 214/653, 654, 655, 147 R, 147 G, 658, 620, DIG. 4, DIG. 3, 130 C; 294/88, 106

[56] References Cited

U.S. PATENT DOCUMENTS

| | | | |
|---|---|---|---|
| 2,683,546 | 7/1954 | Sherriff | 214/652 |
| 2,815,878 | 12/1957 | Vance | 294/88 X |
| 2,904,202 | 9/1959 | Brady | 214/653 |
| 3,198,568 | 8/1965 | Mindrum | 214/651 X |
| 3,9 55,851 | 5/1976 | Umeda et al. | 298/17 B X |

*Primary Examiner*—Frank E. Werner

*Attorney, Agent, or Firm*—Chernoff & Vilhauer

[57] ABSTRACT

A lift truck-mounted load clamp for handling paper rolls having selectively openable and closeable opposing clamp arms with elongate, arcuate, concave contact pads hingedly connected to the forward ends of the respective clamp arms. Each contact pad is provided with exceptionally compact, durable restraints which limit the hinged movement of the respective pad, such restraints each comprising a cable having a swaged-on eye at one end pivotally connected to the contact pad and a swaged-on ferrule at the other end which is slidably contained within a yoke mounted on the clamp arm. A pair of such restraints are provided for each respective contact pad, the restraints being located exterior of each longitudinal edge of the clamp arm rather than interior thereof. A specially formed, heat-treated protective casting is provided on the rear surface of each contact pad which prevents wear and resultant weakening of the hinge joint of each pad, while also preventing wear and weakening of the tips of the pad, and provides an exceptionally durable and strong connection between the respective restraints and the pad.

11 Claims, 6 Drawing Figures

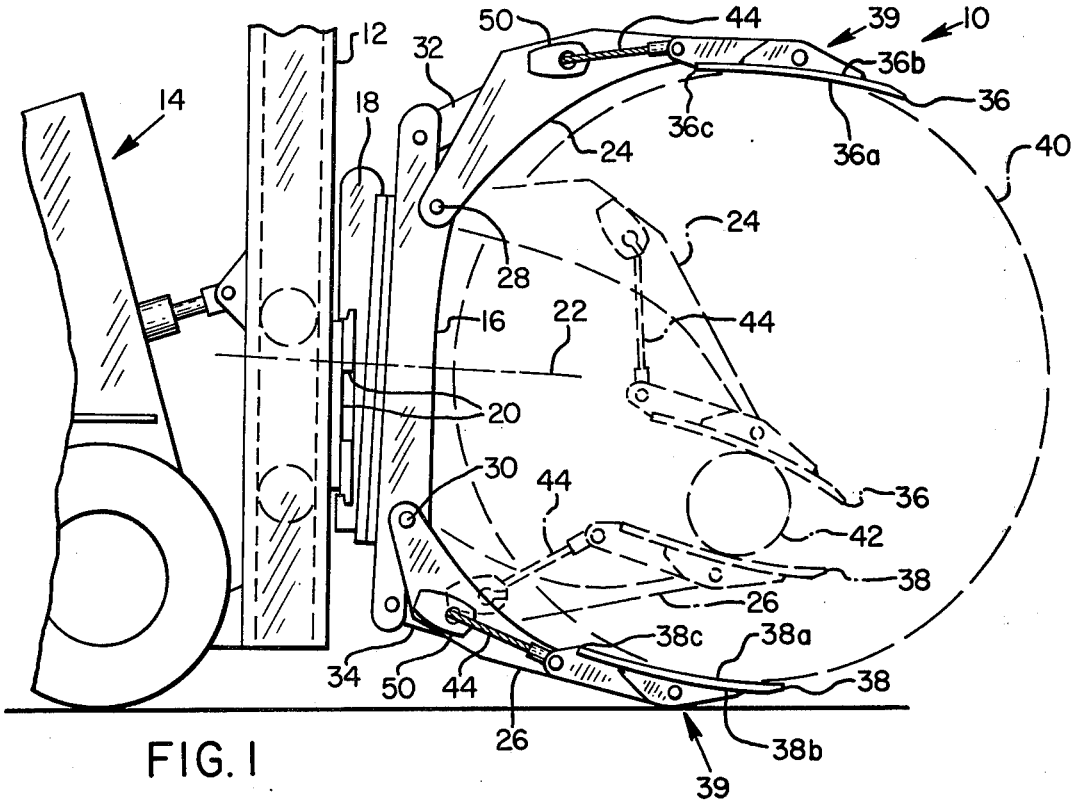
FIG. 1
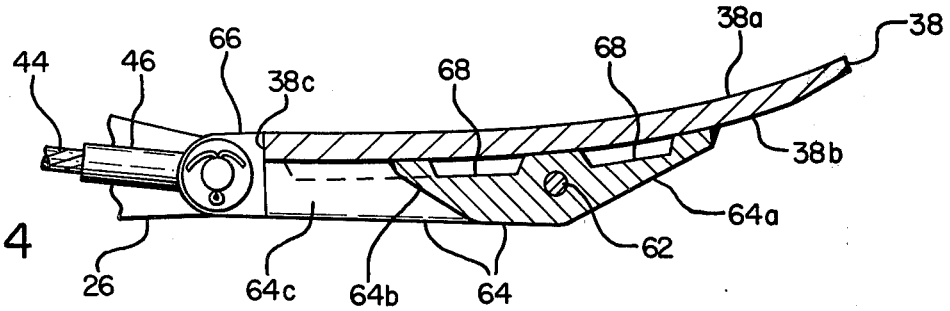
FIG. 4
FIG. 3
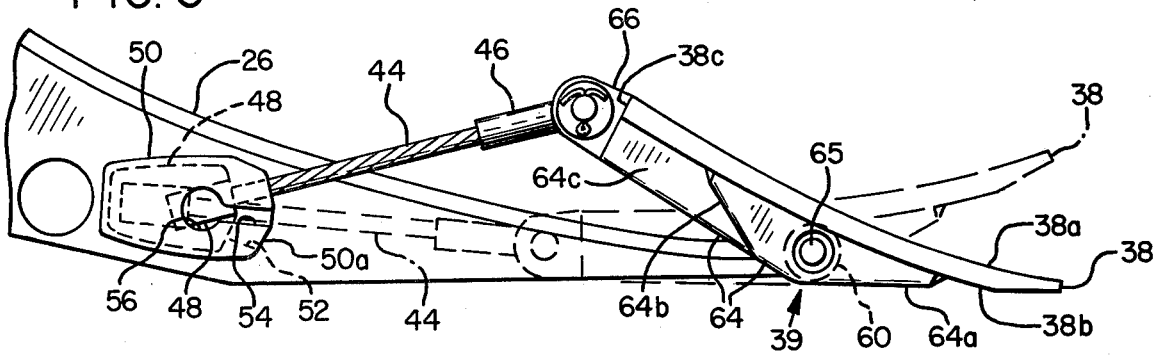

LIFT TRUCK PAPER ROLL CLAMP HAVING IMPROVED CONTACT PAD RESTRAINT AND HINGE STRUCTURE

BACKGROUND OF THE PRESENT INVENTION

The present invention relates to improvements in lift truck-mounted clamping apparatus specifically for picking up, transporting and stacking large rolls of paper such as newsprint and kraft paper. More particularly the invention relates to improvements in the restraints utilized to limit the hinged motion of the roll-engaging contact pads mounted on the protruding ends of the clamp arms, and to means for preventing wear and resultant weakening of the hinge and tips of the contact pads.

Conventional lift truck-mounted paper roll clamps comprise a pair of forwardly-extending, selectively openable and closeable clamp arms mounted on a frame which in turn is rotatably carried by the lifting apparatus at the front of the lift truck, the frame being rotatable about a forwardly-extending axis. The rotation permits the clamp arms to engage the sides of cylindrical paper rolls regardless of whether the rolls are in vertical or horizontal positions, and to rotate the rolls from one position to the other. A small percentage of conventional paper roll clamps are not equipped with the rotation feature, and are thus limited to handling rolls in only one of the two alternative positions.

At each protruding end of the respective clamp arms a respective contact pad is normally mounted, such pad having an elongate, curved, concave roll-engaging surface extending transversely to the lift truck. Each contact pad is conventionally hingedly connected to its respective clamp arm so as to be pivotal with respect to the arm about an axis extending transversely of the lift truck. The hinged movement of the contact pads relative to the respective clamp arms serves several purposes, including permitting the pads conformably to engage the sides of cylindrical paper rolls of widely varying diameter, and permitting the pads to slide easily and comformably along the sides of the rolls without gouging their outer layers during initial engagement of the rolls by the clamp.

It has previously been determined that unrestrained hinged movement of the contact pads with respect to the clamp arms is undesirable because, without limitations on such movement, the pads can pivot far out of their proper positions making engagement of the paper rolls difficult. Accordingly it has been the practice to restrain the hinged movement of the contact pads with respect to the clamp arms to within predetermined limits by connecting a pair of rigid bars pivotally at one end to the rear longitudinal edge of each pad, the opposite ends of the bars being slidably connected to the respective clamp arm at interior positions within the arm structure. The slide structure conventionally includes stops fixed at appropriate locations within the clamp arm so as to limit the sliding movement of the bars, such stops determining the outer extreme of the hinged movement of the contact pad.

A number of problems have arisen from the use of the above-described conventional contact pad restraints in lift truck paper roll clamps. First, the durability of such restraints has generally been unsatisfactory at the slidable connection between the rigid bar and the clamp arm where shock-loading caused by the abrupt sliding engagement of the bar with a respective stop results in cracked welds and broken metal at these locations. Similar failures also occur at the pivotal connection between the opposite end of the bar and the contact pad. The problem is aggravated by the fact that the bars provide a very rigid connection with the contact pads which permits no cushioning of the shock.

Moreover, the size and strength requirements of the pad restraints in the past have dictated that they be located inwardly of the outer longitudinal edges of the clamp arms, the slide structures being located physically inside the arms. Such location has been a limiting factor with regard to the thinness of clamp arms near their protruding ends. It is desirable to provide as thin a structure as possible near the protruding end of a clamp arm so that the arm can easily be inserted between the sides of adjacent rolls or beneath a horizontally oriented roll. However the high strength requirements and resultant location and bulkiness of the conventional pad restraint slide structures, which are located near the protruding ends of the clamp arms, have limited the degree of structural thinness which can be obtained in the end region.

Moreover, the interior location of the slide structures within the body of the clamp arms has required that apertures be formed in the surfaces of the clamp arms to permit the bars to extend from the slide structures to the exterior of the clamp arms for connection to the pads. These apertures, which are of substantial size, weaken the clamp arm structure and cause stress concentrations where fatigue failures can occur. The apertures can also cause damage to adjacent rolls when the rolls are tightly stacked as in rail cars.

Another major problem which has existed in regard to paper roll clamp contact pads is the susceptibility to wear and resultant weakening of both the hinged joint between the pad and clamp arm and the tips of the pad at each longitudinal end thereof. The hinged joint is located on the rear side of the pad opposite its roll-engaging surface and extends longitudinally of the pad. Because the pad, in order to be inserted beneath a horizontally-lying roll, is often scraped along the floor during the insertion process, the rear surface of the pad and particularly the hinge can experience severe wear from frequent floor contact. The wear of the hinge, besides requiring costly replacement of pad or clamp arm components, can also constitute a danger to workmen if the gradual weakening of the hinge goes undetected and breakage occurs, causing the clamp to drop a paper roll.

A related problem exists with respect to the tips of the pad, located at each longitudinal end thereof, which also tend to become worm and weakened because of their contact with floors, walls, posts and other surfaces, particularly in view of the fact that the rotatability of the paper roll clamp permits a pad to be somewhat tilted with respect to the floor during insertion of the pad beneath a horizontal roll, thereby concentrating wear forces at one longitudinal end of the pad.

SUMMARY OF THE PRESENT INVENTION

The present invention is directed to improvements in lift truck paper roll clamps for the purpose of overcoming all of the foregoing deficiencies of conventional clamps. A novel contact pad restraint is provided comprising a wound steel cable having a swaged-on eye at one end pivotally connected to the contact pad and a swaged-on ferrule at the other end which is slidably contained within a yoke mounted on the clamp arm. A pair of such restraints and yokes are provided from each respective contact pad, the restraints and yokes being located exterior of each longitudinal edge of the respective clamp arm rather than interior thereof. The ferrule and yoke assembly provides the slidable, forwardly limited movement required at the rear end of the pad restraint by means of a structure which is more durable and more compact than the slide structures previously used. Durability of the connections at both ends of the restraint is further enhanced by the yieldability of the wound cable which tends to unwind slightly upon the application of tension, thereby providing a small yet important cushioning effect against the shock loading imposed upon the restraint.

Moreover, the ferrule and yoke assembly provides the necessary strength and durability in a much more compact form than has previously been possible, with the result that the ferrule and yoke assemblies may be located exterior of the longitudinal edges of the clamp arm rather than interior thereof as in the prior art. Such exterior mounting permits a thinner clamp arm structure to be employed near the protruding ends of the clamp arms than has previously been possible with conventional slide structures, and obviates the need for any apertures formed in the surfaces of the clamp arm.

The durability and strength of the pivotal connections between the forward ends of the cable restraints and the contact pads is further enhanced by the provision of specially shaped, heat-treated protective castings located on the rear side of each contact pad and extending into the regions of the tips at the ends of the elongate pads. The substantial mass of the heat-treated castings at the tips of the pads provides an integral high-strength pivotal connection for the cable restraints which, because of their outboard positions relative to the clamp arms, are also located adjacent the tips of the pads. Accordingly the castings cooperate with the ferrule and yoke assembly and cable structure to provide exceptionally high strength and durability at the exterior pad restraint locations.

The heat-treated protective castings are specially shaped to protrude rearwardly from the pads beyond the hinge components to ensure that, when the rear of either pad is scraped against a surface such as the floor, the contact is with the hardened material of the heat-treated castings rather than with the softer hinge components, thereby preventing wear and resultant weakening of the hinge components. In addition, the fact that the hardened castings extend to the tips of the contact pads minimizes wear or other damage to the softer material of the tips, which otherwise would occur as described above.

It is therefore a principal objective of the present invention to provide a lift truck-mounted paper roll clamp having an improved contact pad and contact pad restraint structure which provides significantly greater durability and wear resistance than has existed previously with respect to similar equipment.

It is a further principal objective to provide a contact pad restraint structure which reduces previous limitations on the thinness of clamp arms near their protruding forward ends while also strengthening the clamp arm and eliminating stress concentrations inherent in previous designs.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a side view of an exemplary embodiment of a lift truck-mounted paper roll clamp employing the improvements of the present invention.

FIG. 3 is a top view of the contact pad and restraint structure taken along line 3—3 of FIG. 2.

FIG. 4 is a sectional view taken along line 4—4 of FIG. 2.

DETAILED DESCRIPTION OF THE INVENTION

Figures 2, 5, 6:
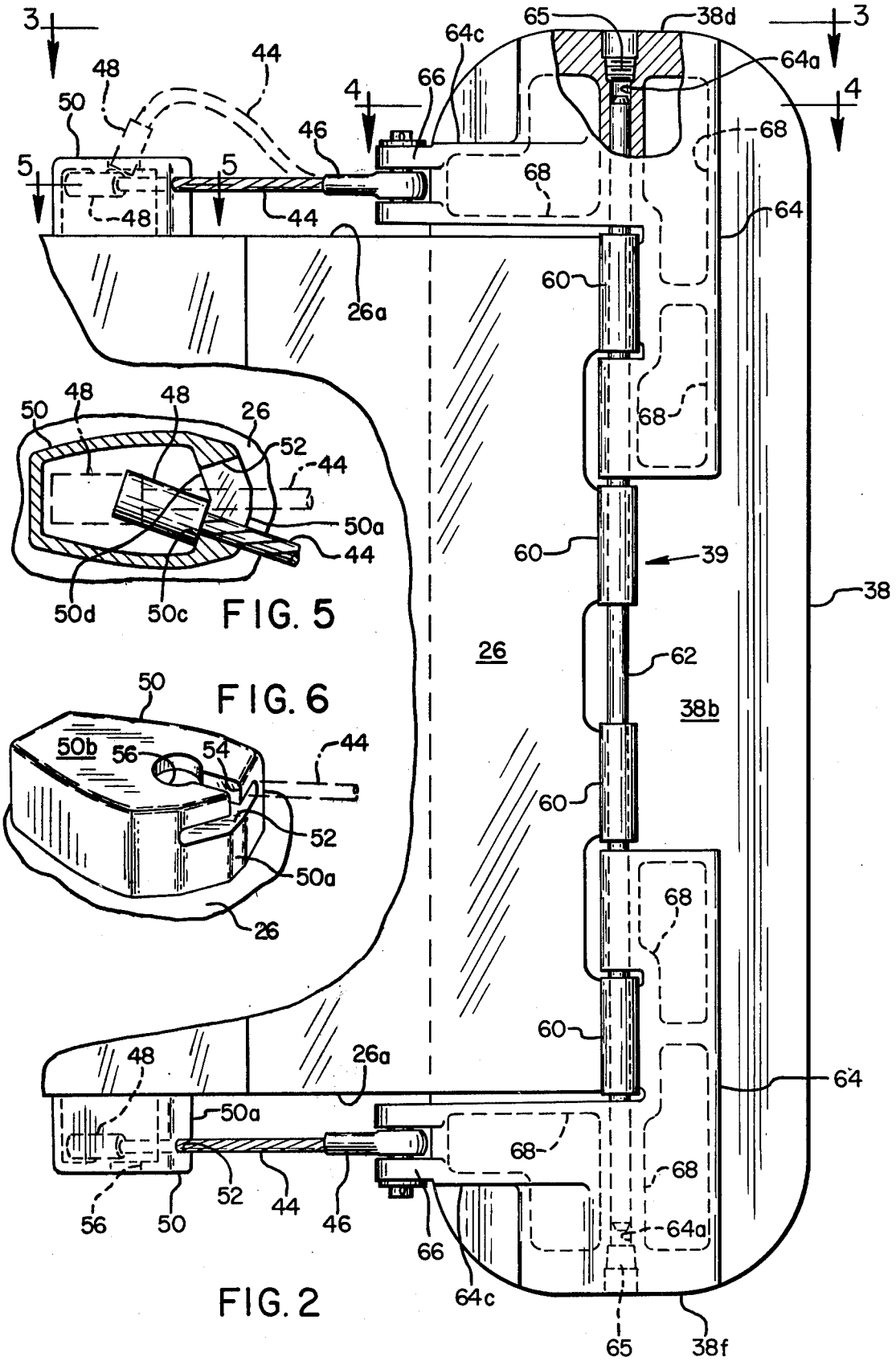
FIG. 2 is a partial rear view of a clamp arm having a contact pad and pad restraint structure in accordance with the present invention, with a portion broken away to reveal inner structure.
FIG. 5 is a detail top sectional view of the ferrule and yoke assembly used in the pad restraint of the present invention.
FIG. 6 is a perspective view of the yoke.

With reference to FIG. 1, an exemplary paper roll handling clamp attachment designated generally as 10 is mounted on a mast 12 at the forward end of a lift truck 14. The clamp 10 has a frame 16 which is mounted, preferably but not necessarily by means of a rotator 18, upon a carriage 20 which moves vertically selectively upward or downward on the mast 12. The rotator 18 provides powered rotation of the frame 16 about an axis of rotation 22 extending generally forwardly from the mast 12 and carriage 20 and longitudinally of the lift truck 14.

Mounted upon the frame 16 are a pair of transversely spaced, forwardly projecting selectively openable and closeable opposing clamp arms 24 and 26 respectively. Although the clamp arms are shown in FIG. 1 as being pivotable about points 28 and 30 with respect to the frame 16 so as to open and close, they might alternatively be slidable with respect to the frame 16 toward and away from one another. Suitable power means such as double-acting hydraulic cylinders 32 and 34 control the movement and position of the respective clamp arms 24 and 26.

Hingedly connected to a forward end of each respective clamp arm 24 and 26 is a respective contact pad 36 and 38. The contact pads 36 and 38 are of elongate shape as best seen in FIG. 2 extending longitudinally in a direction transverse to the forward direction of the lift truck 14, and have opposing front sides **36*a* and 38*a* respectively, comprising paper roll-engaging surfaces of arcuate concave shape, and rear sides 36*b* and 38*b***.

A respective hinge designated generally as 39, which will be described hereafter in greater detail, permits each contact pad to pivot with respect to its clamp arm about an axis transverse to the forward direction of the lift truck. As can be seen from FIG. 1, the hinged movement permits the pads conformably to engage the sides of cylindrical paper rolls, such as 40 and 42 respectively, of widely varying diameters in a conforming, tangential manner both during handling and during initial engagement of the rolls.

Such hinged movement must be limited, however, so that the pads do not pivot sufficiently out of their proper roll-engaging positions as to be incapable of proper roll engagement. Movement wherein the rear edges **36*c* and 38*c* respectively of the contact pads move toward the respective clamp arms 24 and 26** is limited by the ultimate engagement of the rear edge with the clamp arm; however hinged movement in the opposite direction must be resisted by contact pad restraints.

With reference particularly to FIGS. 2, 3 and 4, the contact pad restraints of the present invention comprise a pair of forwardly extending, elongate wound metal cables 44 pivotally connected at their forward ends to a respective contact pad such as 38 and slidably connected at their rearward ends to the respective clamp arm such as 26 upon which the contact pad is hingedly mounted. At the forward end of the cable 44 is a swaged-on eye 46 for pivotal connection to the respective contact pad 38 in a manner to be described more fully hereafter, and at the rearward end of the cable 44 is a swaged-on ferrule 48. The ferrule 48 and rearward end of the cable 44 are slidably connected to the respective clamp arm such as 26 by means of a yoke 50 attached by welding or otherwise to the outside of a respective longitudinal edge such as 26*a* (FIG. 2) of the clamp arm.

As best seen in FIGS. 2, 3, 5 and 6 the yoke 50 comprises a housing having a front wall 50*a*, with a forwardly extending aperture 52 extending through the wall through which the cable 44 slidably extends. The aperture 52 is of a size too small to permit the passage of the ferrule 48, with the result that the wall 50*a* limits the sliding movement of the cable 44 in a forward direction. A channel 54 (FIG. 6) is also formed in the front wall 50*a* in communication with one side of the aperture 52 for permitting the cable 44 to be inserted transversely into the aperture 52 through a side thereof. The channel 54 also communicates with an aperture 56 in the cover 50*b* of the housing 50 which is large enough to permit the passage of the ferrule 48 into and from the housing in the manner shown in dotted lines at the top of FIG. 2. This feature permits easy attachment or detachment of the rearward end of the cable 44 with respect to the yoke 50, while the enclosure formed by the walls and cover of the housing prevent inadvertent escape of the ferrule from its operative position behind the front wall unless the cable 44 has been removed from the aperture 52 through the channel 54.

It will be noted that the aperture 52 has a transverse dimension substantially greater than its vertical dimension, so as to permit angular movement of the cable through the aperture during forward and rearward sliding motion. The necessity for such angular movement is best seen in FIG. 3 which shows the two extremes of the hinged movement of the pad 38 with respect to the clamp arm 26, and the resultant position of the cable 44 and ferrule 48. The wall 50*a* has a pair of plane surfaces 50*c* and 50*d* (FIG. 5) which are angular with respect to one another about the center of the aperture 52 to provide square abutment between the ferrule 48 and the wall 50*a* regardless of the inclination of cable 44. This angled structure of the rear surfaces 50*c* and 50*d* of wall 50*a*, together with the transverse extension of the aperture 52 on either side of the center thereof, permits a single yoke structure to be utilized interchangeably for both the top and bottom restraints of either clamp arm.

As can be seen from FIG. 2, the entirety of each restraint and its associated yoke assembly are located along a respective one of the opposite longitudinal edges such as 26*a* of the clamp arm and positioned exterior of these edges, thereby obviating the need for any restraint structure interior of the clamp arm or the need for apertures within the body of the clamp arm through which the restraints extend.

In operation, hinged movement of the contact pad 38 in a counterclockwise direction as seen in FIG. 3 causes the ferrule 48 and cable 44 to slide rearwardly with respect to the yoke 50, such movement being limited by the abutment of the rear edge 38*c* of the pad with the inside surface of the clamp arm 26. Hinged movement of the pad 38 in the opposite direction slides the cable 44 and ferrule 48 forwardly until the ferrule engages the rear side of the wall 50*a*, halting the movement. Such engagement is often with great force, but in such circumstances the wound cable 44 composed of any intertwisted metal wires tends to relieve the shock to a small but significant degree by yieldably unwinding slightly under tension, thereby cushioning the application of force.

The hinge structure, designated generally as 39, by which the respective contact pads art connected to the respective clamp arms includes a portion fixed to the clamp arm comprising a series of spaced tubular members 60 (FIG. 2) through which an elongate hinge pin 62 passes. The hinge pin 62 is pivotally engaged by the rear side, such as 38*b*, of the respective contact pad along the approximate longitudinal center line of the contact pad, making it necessary that the components of the hinge 39 protrude rearwardly from the rear side of the contact pad by a predetermined distance, exposing them to frequent scraping against the floor as previously described.

To prevent the resultant wear and weakening of the hinge structure, protective steel castings 64 are welded to the rear surface of the respective contact pad adjacent each longitudinal end thereof, such as 38*d* and 38*f* (FIG. 2), to perform the following multiple functions. First, the castings 64 contain apertures 64*a* through which the hinge pin 62 passes, as seen in FIGS. 2 and 4, thereby forming a portion of the hinge assembly 39. Threaded retaining plugs 65 prevent dislodgement of the pin 62.

More importantly, the castings 64 perform the additional function of protecting the hinge assembly from wear. As a result of heat treatment, the castings are harder and more wear-resistant than the materials from which the contact pad and hinge tubular members 60 are constructed and, as can be seen from FIG. 3, the castings 64 protrude rearwardly from the rear side of the contact pad a distance at least as great and preferably greater than the protrusion of the tubular members 60 thereby absorbing floor contact and protecting the tubular members. The leading surfaces 64*a* of the castings are tapered forwardly toward the rear surface of the contact pad so as to provide a minimum resistance to forward movement despite the protective function provided by the castings 64.

As seen in FIG. 2, the protective castings 64 also extend longitudinally along the rear side of the contact pad so as to encompass both longitudinal ends 38*d* and 38*f* of the contact pad. The cross section of the castings in these end regions is shown in FIG. 4 to comprise a very substantial mass of hardened material which provides excellent protection against wear to the ends of the softer pad from concentrated scraping loads which otherwise severely damage and weaken the ends. Since the end regions of the pad protrude transversely beyond the longitudinal edges of the clamp arm, both forward and rearward tapered surfaces 64*a* and 64*b* respectively are provided in these regions to minimize resistance to forward and reverse movement relative to other surfaces and objects.

Each casting 64 also includes an integral rearwardly extending leg 64c having a pivotal clevis connection 66 formed therein located outwardly of the longitudinal edges of the clamp arm, the clevis 66 being constructed so as to mate with the swaged-on eye 46 of the cable restraint 44 to form a highly durable pivotal connection between restraint and contact pad. The substantial mass of the castings 64 in the end regions of the pad, primarily for the purpose of protecting the ends, thus also provides an exceptionally strong base for the legs 64c and pivotal connections 66, thereby contributing significantly to the overall strength and durability of the pad restraint structure.

The various functions performed by the protective castings 64 are in large part a result of their size and shape, together with their hardness. To avoid undue weight from the castings, applied at the forward ends of the clamp arm where such weight would detract from the load-lifting capacity of the lift truck, the castings have cavities 68 formed therein to minimize their mass without detracting from their various functions.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A load-handling clamp adapted to be mounted upon the lifting apparatus at the forward end of a lift truck for engaging a roll of paper comprising:

(a) a frame adapted to be mounted upon said lifting apparatus so as to be selectively movable vertically by said lifting apparatus;

(b) a pair of selectively openable and closeable opposing clamp arms mounted upon said frame projecting longitudinally therefrom in a forward direction, said clamp arms each having longitudinal edges extending longitudinally along opposite sides thereof;

(c) power means mounted upon said frame for selectively opening and closing said clamp arms;

(d) contact pad means hingedly connected to a forward end of a respective one of said pair of clamp arms for pivoting with respect to the respective clamp arm about an axis transverse to said forward direction; and (e) a pair of restraint means for limiting the pivotal movement of said contact pad means with respect to its respective clamp arm, each of said pair of restraint means comprising a forwardly extending elongate member pivotally connected at its forward end to the respective contact pad means and connecting means for slidably connecting the rearward end of said elongate member to the respective clamp arm and limiting the sliding movement of said member with respect to said clamp arm in a forward direction, the elongate member and connecting means of each of said pair of restraint means being located along a respective one of the opposite longitudinal edges of said clamp arm and positioned exterior of the respective edge.

2. A load-handling clamp adapted to be mounted upon the lifting apparatus at the forward end of a lift truck for engaging a roll of paper, comprising:

(a) a frame adapted to be mounted upon said lifting apparatus so as to be selectively movable vertically by said lifting apparatus;

(b) a pair of selectively openable and closeable opposing clamp arms mounted upon said frame projecting longitudinally therefrom in a forward direction;

(c) power means mounted upon said frame for selectively opening and closing said clamp arms;

(d) contact pad means hingedly connected to a forward end of a respective one of said pair of clamp arms for pivoting with respect to the respective clamp arm about an axis transverse to said forward direction;

(e) restraint means for limiting the pivotal movement of said contact pad means with respect to its respective clamp arm, said restraint means comprising a forwardly extending elongate wound cable of intertwisted metal wires pivotally connected at its forward end to the respective contact pad means; and (f) connecting means for slidably connecting the rearward end of said cable to the respective clamp arm and limiting the sliding movement of said cable in a forward direction with respect to said clamp arm, said connecting means comprising a yoke fixedly attached to the respective clamp arm, said cable slidably passing through said yoke and having ferrule means connected to the rearward end of said cable for engaging said yoke upon forward movement of said cable and, by said engagement, limiting said forward movement, said yoke comprising a housing enclosing said ferrule means and having a front wall with a forwardly extending aperture formed therein of a size too small to permit passage of said ferrule means, and means defining a channel formed in said front wall in communication with one side of said aperture for permitting said cable to be inserted transversely into said aperture through the side thereof, said housing having means defining a further aperture formed therein in communication with said channel of a size large enough to permit the passage of said ferrule means.

3. A load-handling clamp adapted to be mounted upon the lifting apparatus at the forward end of a lift truck for engaging a roll of paper, comprising:

(a) a frame adapted to be mounted upon said lifting apparatus so as to be selectively movable vertically by said lifting apparatus;

(b) a pair of selectively openable and closeable opposing clamp arms mounted upon said frame projecting longitudinally therefrom in a forward direction, said clamp arms each having longitudinal edges extending along opposite sides thereof;

(c) power means mounted upon said frame for selectively opening and closing said clamp arms;

(d) contact pad means hingedly connected to a forward end of a respective one of said pair of clamp arms for pivoting with respect to the respective clamp arm about an axis transverse to said forward direction; and (e) a pair of restraint means extending between said contact pad means and its respective clamp arm, for limiting the pivotal movement of said contact pad means with respect to its respective clamp arm, each of said pair of restraint means comprising a forwardly extending elongate wound cable of intertwisted metal wires pivotally connected at its forward end to the respective contact pad means, and connecting means for slidably connecting the rearward end of said cable to the respective clamp arm and limiting the sliding movement of said cable in a forward direction with respect to said clamp arm, the cable and connecting means of each of said pair of restraint means being located along a respective one of the opposite longitudinal edges of said clamp arm and positioned exterior of the respective edge.

4. A load-handling clamp adapted to be mounted upon the lifting apparatus at the forward end of a lift truck for engaging a roll of paper, comprising:

(a) a frame adapted to be mounted upon said lifting apparatus so as to be selectively movable vertically by said lifting apparatus;

(b) a pair of selectively openable and closeable opposing clamp arms mounted upon said frame projecting longitudinally therefrom in a forward direction, said clamp arms each having longitudinal edges extending longitudinally along opposite sides thereof;

(c) power means mounted upon said frame for selectively opening and closing said clamp arms;

(d) contact pad means hingedly connected to a forward end of a respective one of said pair of clamp arms for reciprocally pivoting with respect to the respective clamp arm about an axis transverse to said forward direction; and (e) restraint means for limiting the pivotal movement of said contact pad means with respect to its respective clamp arm, said restraint means comprising a forwardly extending elongate member having a forward end and a rearward end, and connecting means connecting said elongate member at its forward end to said contact pad means and at its rearward end to the respective clamp arm for permitting reciprocating pivotal movement of said contact pad means with respect to the respective clamp arm and limiting said reciprocating pivotal movement, the elongate member and connecting means of said restraint means being located along a respective one of the longitudinal edges of said clamp arm and positioned exterior of the respective edge.

5. The apparatus of claim 4 wherein said elongate member comprises a wound cable of intertwisted metal wires.

6. A load-handling clamp adapted to be mounted upon the lifting apparatus at the forward end of a lift truck for engaging a roll of paper, comprising:

(a) a frame adapted to be mounted upon said lifting apparatus so as to be selectively movable vertically by said lifting apparatus;

(b) a pair of selectively openable and closeable opposing clamp arms mounted upon said frame projecting longitudinally therefrom in a forward direction;

(c) power means mounted upon said frame for selectively opening and closing said clamp arms;

(d) contact pad means hingedly connected to a forward end of a respective one of said pair of clamp arms for reciprocally pivoting with respect to the respective clamp arm about an axis transverse to said forward direction; and (e) restraint means for limiting the pivotal movement of said contact pad means with respect to its respective clamp arm, said restraint means comprising a forwardly-extending elongate wound cable of intertwisted metal wires having a forward end and a rearward end, and connecting means engaging the forward end of said cable with said contact pad means and the rearward end of said cable with the respective clamp arm for permitting reciprocating pivotal movement of said contact pad means with respect to the respective clamp arm and limiting said reciprocating pivotal movement; and (f) means associated with said connecting means for preventing both said forward and rearward ends of said cable from being disengaged respectively from said contact pad means and the respective clamp arm during said reciprocating pivotal movement of said contact pad means.

7. The apparatus of claim 6 wherein said connecting means comprises a yoke fixedly attached to the respective clamp arm, said cable passing through said yoke in slidable engagement with said yoke, said cable having ferrule means connected to the rearward end thereof for engaging said yoke upon forward movement of said cable and, by said engagement, limiting said forward movement, said yoke including means enclosing said ferrule for maintaining said slidable engagement of said cable with said yoke during said reciprocating pivotal movement of said contact pad means.

8. The apparatus of claim 6 wherein said connecting means includes means for slidably connecting the rearward end of said cable to the respective clamp arm for permitting reciprocating forward and rearward movement of said cable with respect to the respective clamp arm and limiting the sliding movement of said cable in a forward direction, said connecting means further including means for retaining said rearward end of said cable, during said reciprocating forward and rearward movement of said cable, in such a position with respect to said connecting means that said rearward end engages said connecting means in tension upon said forward movement of said cable thereby limiting said forward movement.

9. The apparatus of claim 6 wherein said clamp arms each have longitudinal edges extending longitudinally along opposite sides thereof and the cable and connecting means of said restraint means are located along a respective one of the longitudinal edges of said clamp arm and positioned exterior of the respective edge.

10. A load-handling clamp adapted to be mounted upon the lifting apparatus at the forward end of a lift truck for engaging a roll of paper, comprising:

(a) a frame adapted to be mounted upon said lifting apparatus so as to be selectively movable vertically by said lifting apparatus;

(b) a pair of selectively openable and closeable opposing clamp arms mounted upon said frame projecting longitudinally therefrom in a forward direction, said clamp arms each having longitudinal edges extending forwardly along opposite sides thereof;

(c) power means mounted upon said frame for selectively opening and closing said clamp arms;

(d) a contact pad, connected to a forward end of a respective one of said pair of clamp arms, having a rear side and a front side, the front side facing the other one of said pair of clamp arms, and being of elongate shape extending longitudinally in a direction transverse to said forward direction between a pair of longitudinal ends which protrude beyond the longitudinal edges of the respective clamp arm, said pad having a paper roll-engaging surface of elongate, arcuate, concave shape on the front side thereof;

(e) a hinge connecting the forward end of the respective one of said pair of clamp arms to said contact pad so as to permit the contact pad to pivot with respect to the clamp arm about an axis transverse to said forward direction, said hinge having a hinge portion fixedly connected to the clamp arm for pivotally engaging the rear side of the contact pad, said hinge portion protruding rearwardly from the rear side of the contact pad a predetermined distance; and (f) protective means, connected to the rear side of the contact pad engaged by said hinge portion, of a material more wear-resistant than the material of said contact pad and hinge portion, said protective means being located adjacent said hinge portion and protruding from the rear side of the contact pad a distance at least as great as said predetermined distance for protecting said hinge portion from wear, said protective means extending longitudinally along the rear side of the contact pad beyond the longitudinal edges of the respective clamp arm substantially to the protruding ends of the contact pad in a forwardly tapered configuration so as also to protect said protruding ends from wear.

11. The apparatus of claim 10 wherein said protective means has a rearwardly extending leg formed integrally therewith at a location exterior of a respective longitudinal edge of the respective clamp arm, said apparatus further including restraint means connected to said leg and extending between said leg and the respective clamp arm, exterior of the respective longitudinal edge of the clamp arm, for limiting the pivotal movement of the contact pad relative to the clamp arm.

* * * * *

UNITED STATES PATENT AND TRADEMARK OFFICE

CERTIFICATE OF CORRECTION

PATENT NO. : 4,160,620

DATED : July 10, 1979

INVENTOR(S) : Stanley E. Farmer and Harry F. Weinert

It is certified that error appears in the above-identified patent and that said Letters Patent are hereby corrected as shown below:

Col. 2, line 51 Change "worm" to --worn--.

Col. 6, line 11 Change "any" to --many--.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*